US007444941B1

(12) United States Patent
Brunn et al.

(10) Patent No.: US 7,444,941 B1
(45) Date of Patent: Nov. 4, 2008

(54) LOW LETHALITY PROJECTILE

(75) Inventors: Michael Brunn, Sea Cliff, NY (US); Jacob Kravel, Great Neck, NY (US)

(73) Assignee: Combined Systems, Inc., Plainview, NY (US)

( * ) Notice: Subject to any disclaimer, the term of this patent is extended or adjusted under 35 U.S.C. 154(b) by 0 days.

(21) Appl. No.: 11/464,477

(22) Filed: Aug. 14, 2006

Related U.S. Application Data

(63) Continuation of application No. 10/873,331, filed on Jun. 21, 2004, now Pat. No. 7,089,864, which is a continuation of application No. 10/114,726, filed on Apr. 2, 2002, now Pat. No. 6,755,133, which is a continuation of application No. 09/648,559, filed on Aug. 28, 2000, now Pat. No. 6,374,742, which is a continuation-in-part of application No. 09/434,453, filed on Nov. 5, 1999, now Pat. No. 6,202,562.

(51) Int. Cl.
*F42B 12/34* (2006.01)

(52) U.S. Cl. ..... 102/502; 102/444

(58) Field of Classification Search ..... 102/501, 102/502, 444, 439, 529, 293, 507, 510; 244/3.3
See application file for complete search history.

(56) References Cited

U.S. PATENT DOCUMENTS

| | | | | |
|---|---|---|---|---|
| 3,147,976 | A * | 9/1964 | Millar | 273/348.3 |
| 3,393,911 | A | 7/1968 | Lawson | |
| 3,480,280 | A * | 11/1969 | Gamertsfelder | 473/594 |
| 3,604,352 | A * | 9/1971 | Bench | 102/386 |
| 3,710,720 | A | 1/1973 | Mawhinney | |
| 3,815,502 | A * | 6/1974 | Mawhinney | 86/23 |
| 3,952,662 | A | 4/1976 | Greenlees | |
| 4,644,930 | A | 2/1987 | Mainhardt | |
| 4,823,702 | A | 4/1989 | Woolsey | |
| 4,826,179 | A * | 5/1989 | Callaghan | 473/575 |
| 4,943,065 | A * | 7/1990 | DeLapa | 273/402 |
| 4,943,066 | A * | 7/1990 | Lathim et al. | 473/576 |
| 5,112,061 | A * | 5/1992 | Lamle | 473/473 |
| RE34,032 | E | 8/1992 | Callaghan | |
| 5,259,319 | A | 11/1993 | Dravecky | |
| 5,310,194 | A | 5/1994 | Scheel | |
| 5,450,795 | A | 9/1995 | Adelman | |
| 5,492,320 | A * | 2/1996 | Hoffman et al. | 473/594 |
| 5,706,756 | A * | 1/1998 | Cunningham et al. | 116/173 |
| 5,750,918 | A | 5/1998 | Mangolds et al. | |
| 5,831,199 | A | 11/1998 | McNulty et al. | |
| 5,893,811 | A * | 4/1999 | Stover et al. | 473/575 |
| 5,898,125 | A | 4/1999 | Mangolds et al. | |
| 6,083,128 | A * | 7/2000 | Young et al. | 473/576 |
| 6,302,028 | B1 * | 10/2001 | Guillot-Ulmann et al. | 102/502 |
| D456,742 | S * | 5/2002 | Williams | D11/165 |

FOREIGN PATENT DOCUMENTS

JP 2000167095 A * 6/2000

* cited by examiner

*Primary Examiner*—James S Bergin
(74) *Attorney, Agent, or Firm*—Venable, Campillo, Logan & Meaney, P.C.

(57) ABSTRACT

An anti-personnel projectile launched from a weapon shell required at impact to have a low lethality consequence, in which the projectile is fitted in the shell in a shape characterized by a blunt end in the direction of flight and maintained in this shape by oppositely directed air resistance and propelling forces to obviate a change of shape during flight that might cause a serious injury.

23 Claims, 1 Drawing Sheet

LOW LETHALITY PROJECTILE

This is a continuation of U.S. application Ser. No. 10/873,331 filed Jun. 21, 2004 now U.S. Pat. No. 7,089,864, which is a continuation of U.S. application Ser. No. 10/114,726 filed Apr. 2, 2002 now U.S. Pat. No. 6,755,133, which is a continuation of earlier filed U.S. application Ser. No. 09/648,559 filed Aug. 28, 2000 now U.S. Pat. No. 6,374,742, which is a continuation-in-part of U.S. patent application Ser. No. 09/434,453 filed Nov. 5, 1999, now U.S. Pat. No. 6,202,562.

BACKGROUND OF THE INVENTION

1. Field of the Invention

The present invention relates generally to projectiles used primarily for low lethality antipersonnel end use, as for example for crowd control by a municipality police force, and more particularly relates to improvements for assuring that a projectile in use will have the requisite low lethality consequence upon impact, and thus avoiding unintentional severe injury to any individual.

2. Discussion of the Related Art

The need for low lethality projectiles is well known in the art, and additionally can be inferred from the promulgation by the National Institute of Justice of low lethality-qualifying standards exemplified by its standard 0101.03 tests. A known projectile which currently is a low lethality munition of choice consists of a flat bag which is folded in half to fit within a 12 gauge shotgun shell, and after exiting from the muzzle is supposed to unfold into a flat bag shape and impact in this flat bag shape upon a target. As such the kinetic energy is distributed over the area of the bag instead of at a point as in regular ammunition. As a consequence there is less of a possibility of an undesirable penetration while permitting the delivery of a desirable incapacitating impact.

The shape of the above described projectile at impact is not always predictable based solely on its construction as a bag, because the bag can be flat at impact only if it unfolds after exiting from the muzzle. However, on numerous occasions in practice it does not unfold and contacts a target with its folded together side edges and thus, with a shape that can, and often does, inflict serious injury. The inability to predict the projectile shape that will contact the target is believed to occur when several shapes are involved such as, in the case of the above described projectile, i.e., a first shape to accommodate the size dimensions to facilitate being loaded into the 12 gauge shotgun shell, and a second shape to achieve a low lethality consequence upon impact.

Logic dictates that the need to change shapes during flight is a happenstance that perhaps most often will occur but which might not occur on occasion due to the shape-change complication.

SUMMARY OF THE INVENTION

Broadly, it is an object of the present invention to provide a low lethality anti-personnel projectile overcoming the foregoing and other shortcomings of the prior art.

More particularly, it is an object to impose a low lethality contacting surface of the projectile at impact.

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF AN EMBODIMENT

By way of one example of many to serve as background in understanding the present invention, in police management of an unruly crowd, even kept at bay by a barricade, it often escalates to a confrontation between the police and an individual crossing the barricade, which necessitates management of the individual. It is police standard operating procedure to limit force in such a confrontation commensurate to the danger posed. A first and lowest level of force dictated by the circumstances would be to strike the individual, typically at eight to twenty yards, with a low lethality munition, i.e., a munition that does not kill or seriously maim the individual. If, however, continuing with the example, the individual withdraws a concealed weapon, the use of a lethal munition would be dictated.

Figure 4:
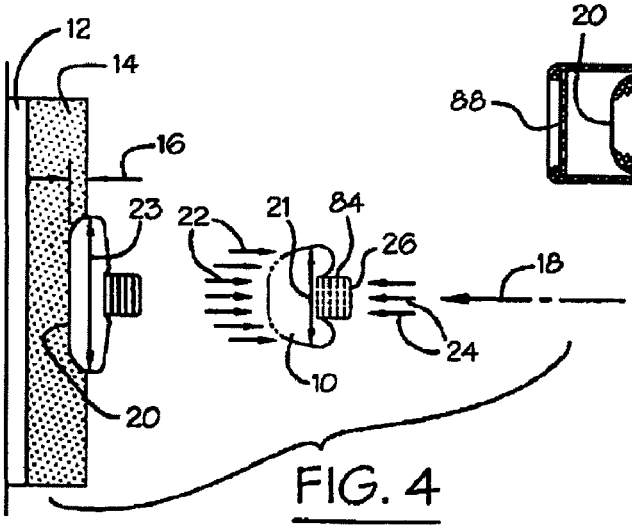
FIG. 4 is an elevational view showing, in full line, the shape of the projectile at impact, and in phantom perspective, the shape of the projectile in flight.

To qualify a munition as being of low lethality, and as best understood from FIG. 4, the projectile 10 is subjected to testing similar to the standard 0101.03 tests used by the National Institute of Justice, which 0101.03 tests to determine the effectiveness of, for example, a "bulletproof vest measures the depth of deformation of a projectile in a known specific type of viscous clay. Thus, in the testing of projectile 10, there is applied on a target 12, a selected thickness of said known viscosity of clay 14 and it is required that in the typical range of confrontation that a projectile fired from a weapon (not shown) not penetrate the clay 14 beyond a specified depth 16, which currently is 40 mm.

Underlying the present invention is the recognition that projectile 10, although having physical attributes that might disqualify it as low lethality, can be shaped preparatory to being fired along a path of flight 18 to the target 12 with a blunt or flat end 20 and, most important, that this optimum shaped end 20 is effectively maintained during flight 18 by air resistant forces 22 exerted against the front or blunt end 20 of the projectile 10 and the opposite direction flight-propelling forces 24 exerted against the rear end 26 of the projectile 10. Stated somewhat differently, the opposing forces 22 and 24 maintain an interposed cylindrical shape 28 in the body of the projectile 10, and this shape 28 is characterized by the noted blunt end 20 and, as a result, does not impact upon the target 12 with a lethal consequence.

In practice in fact, the opposite directional forces 22 and 24 cause the projectile blunt end 20 to undergo a progressive expanse during flight, as noted at 21, and at impact, as noted at 23.

Figure 1:
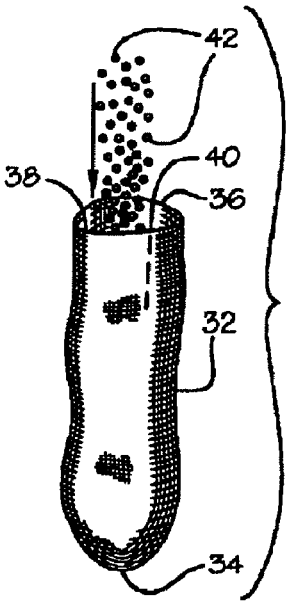
FIG. 1 is a perspective view of a projectile in accordance with the present invention in a work-in-process condition.
Figure 2:
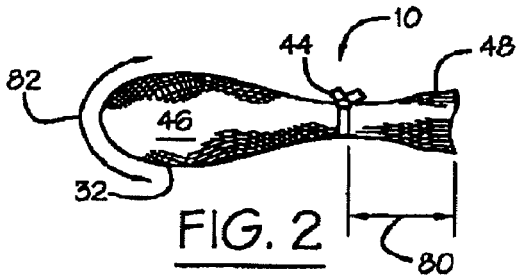
FIG. 2 is an elevational view of the constructed projectile preparatory to being loaded into a weapon shell.

To achieve low lethality utility, projectile 10 is constructed using a tubular sock-like body of stretchable fabric construction material 32 having a closed front end 34 and a rear edge 36 bounding an opening 38 into a body compartment 40. In a work-in-process condition, as illustrated in FIG. 1, a deformable mass (e.g. metal shot, rubber pellets, gel packet(s), etc.), individually and collectively designated 42, is inserted through the opening 38 to partially till the compartment 40, particularly in the area of the closed end 34. As best shown in FIG. 2, the construction of the projectile 10 is completed by a tie or the like, as at 44, which delineates the deformable mass-filled body 46 from a length portion or tail 48 of the fabric construction material 32.

Figure 3:
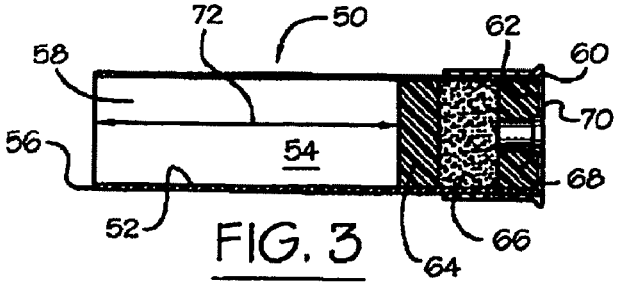
FIG. 3 is a longitudinal cross sectional view of an empty weapon shell.

To launch or propel the constructed projectile of FIG. 2, use is made of an empty weapon shell, which in FIG. 3 is selected for illustration to be a 37 mm weapon shell but which also could be a 40 mm, or a 12-gauge weapon shell. The weapon used for the 37 mm shell is in the parlance of munitions a so-called riot or gas gun used by and for law enforcement, and the weapon used for the 40 mm shell, again in the parlance of munitions, is a so-called grenade launcher used by the military. The 37 mm, 40 mm, and 12-gauge weapons and associated shells are hereafter referred to by the designation weapon shell(s).

Each shell is generally designated 50, and the FIG. 3 illustration thereof having a cylindrical wall 52 bounding a compartment 54. Wall 52 has a front edge 56 bounding an opening 58 into the compartment 54 and a rear wall 60 serving as a closure for the compartment. Prior to loading the projectile 10 through the front opening 58 and into the compartment 54, there is positioned in the rear of casing 50 a plastic cap 64 which holds propellant 66 in combustible relation to a primer 68. In munitions parlance, the plastic cap 64 is generally known as a "wad," "pressure wad," or "gas wad," and functions like a piston, pushing the projectile out of the shell and down the barrel while containing the gasses behind it as well as protecting the projectile 10 against the heat of explosion.

For completeness' sake, it is noted that although the dimensions of the 37 mm weapon shell are well known, that these dimensions as related to the loading of the projectile 10 within the compartment 54 are a compartment length 72 of 3.5 inches with the propellant 66 in place and a diameter 74 of approximately 1.5 inches, and that the 40 mm weapon shell similarly has a compartment length of 3.5 inches, not including the propellant 66, and a slightly larger diameter. It is noted that in practice best results are achieved with a constructed projectile 10 having a length 76 from its closed end 34 to the applied tie of approximately 4 inches and, flattened by slight finger pressure, a maximum width 78 of approximately 2 inches. The tail 48 is cut to length 80 but preferably should not exceed 4 inches.

The dimensions of the 12-gauge shell are also well known. These dimensions are related to the loading of the projectile 10 within the compartment 54 and are a compartment length 72 of 2 1/16ths inches and a diameter 74 of 3/8ths of an inch. It is noted that best results have been observed with a constructed projectile 10 having a length 76 from its closed end 34 to the applied tie of approximately 1 3/4 inches and, flattened by slight finger pressure, a maximum width 78 of approximately 1 inch. The tail 48 is cut to length 80 but preferably should not exceed 2 1/2 inches.

The bulk of the FIG. 2 constructed projectile 10 is then manually stuffed through the front opening 58 into the compartment 54 which, not only of course properly positions the projectile 10 for firing, but also reshapes the projectile 10 so it can qualify for low lethality end use. Without this reshaping, the curvature shape 82 of the projectile front end 34 would penetrate the field-testing clay 14 beyond the depth 16, and thus disqualify the projectile 10 as a low lethality munition.

Figure 3A:
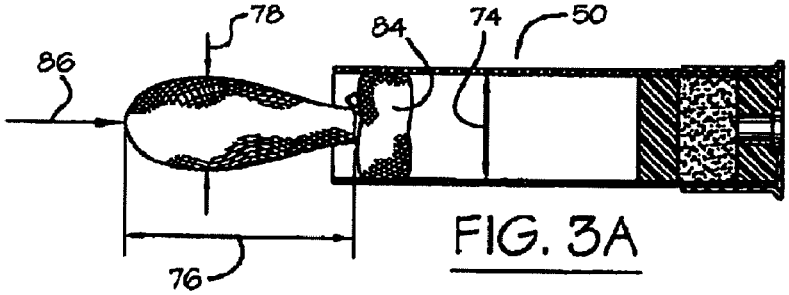
FIGS. 3A & 3B are similarly longitudinal cross sectional views, but showing, in sequence, the loading of the projectile of FIG. 2 into the weapon shell of FIG. 3.

In the preferred loading sequence of the projectile 10 into the shell compartment 54, the tail 48 is folded into a resulting bulk, as at 84, and in this folded configuration is urged in movement 86 into the compartment 54, as illustrated in FIG. 3A. Continuing to apply the force 86, the deformable mass-filled projectile front 34 is worked fully into the compartment 54, as illustrated in FIG. 3B, aided by rotational twists of the projectile front end 34 in addition to the longitudinally directed force 86.

Alternatively, the projectile 10 can be inserted through a funnel (not shown); preferably tail first, and will assume a folded configuration as a result of being compressed between the deformable mass-filled body 32 and the rear confines of the shell 50. After either loading sequence, the shell front end opening 58 in then closed in a well known fashion by an appropriate closure 88 appropriately seated and held in place in the end opening 58.

Figure 3B:
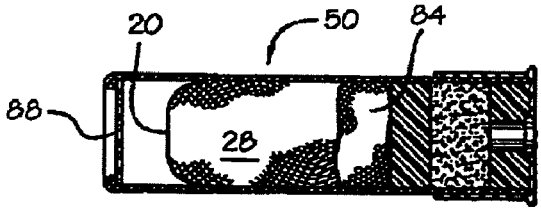

The propellant 66 is then ignited, in a well understood manner, by the primer 68 which, also in a well understood manner, causes the projectile 10 in the shape illustrated in FIG. 3B and is characterized by a blunt-shaped front end 20, reshaped thereinto from a curvature shape 82, to be launched along a path of movement 18 for eventual impact against the target 12 wherein the forces 22 and 24 maintain the blunt shape of the front end 34 during flight movement 18 and, consequently also at impact.

It should be noted that force 24 exists as an applied influence on the shaping of the projectile 10 during flight as a result of the reaction to the decelerating force 22, but not as part of the force causing the projectile 10 to be accelerated down the barrel of the launching weapon which, as generally understood, is a force of the expanding gas phenomenon of the ignited primer 68, since said expanding gas force ceases when the projectile 10 exits from the weapon barrel.

It is further to be noted that the projectile 10 requires ballast which as hereinbefore noted preferably is to consist of the deformable mass 42 which in practice provides a desired volume, a weight not exceeding 60 grams in the size fabric body 32 noted and is particulate in nature. However, it is to be understood that deformable masses 42 and particulate ballast pellets of materials other than rubber can be used and provide similar projectile weight and volume to achieve a low lethality consequence.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design here in shown other than as defined in the appended claims.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A low lethality projectile comprising:

a. a ballast; and b. a tubular body comprising, a closed front end, a rear edge bounding a rear opening, c. a constriction located forward of said rear opening that secures said ballast within said tubular body at the closed front end;

d. a tail portion from said constriction to said rear edge; and e. a weapon shell such that said low lethality projectile is inserted into said weapon shell.

2. The low lethality projectile of claim 1 wherein, a. said constriction is created by a tie wherein said tie is circumferentially tied around a portion of said tubular body forward of said rear edge.

3. The low lethality projectile of claim 1 wherein, a. said constriction is created by binding a portion of said tubular body forward of said rear edge.

4. The low lethality projectile of claim 1 wherein, a. said constriction is created by sewing a portion of said tubular body forward of said rear edge.

5. The low lethality projectile of claim 1 wherein, a. said tubular body is sock-like in shape.

6. The low lethality projectile of claim 1 wherein, a. said ballast is lead shot.

7. The low lethality projectile of claim 1 wherein, a. said ballast comprises a gel.

8. The low lethality projectile of claim 1 wherein, a. said ballast is comprised of particulate matter.

9. The low lethality projectile of claim 1 wherein, a. said tubular body is comprised of fabric material.

10. A low lethality projectile comprising:

a. a plurality of lead shot;

b. a tubular body comprising, a closed front end, a rear edge bounding a rear opening;

c. a constriction located forward of said rear opening that secures said plurality of lead shot within said tubular body at the closed front end;

d. a tail portion from said constriction to said rear edge; and e. a weapon shell such that said low lethality projectile is inserted into said weapon shell.

11. The low lethality projectile of claim 10 wherein, a. said constriction is created by a tie wherein said tie is circumferentially tied around a portion of said tubular body forward of said rear edge.

12. The low lethality projectile of claim 10 wherein, a. said constriction is created by sewing a portion of said tubular body forward of said rear edge.

13. The low lethality projectile of claim 10 wherein, a. said constriction is created by binding a portion of said tubular body forward of said rear edge.

14. The low lethality projectile of claim 10 wherein, a. said tubular body is sock-like in shape.

15. A low lethality munition comprising:

a. a projectile, said projectile further comprising i. a ballast;

ii. a tubular body comprising: a closed front end and a rear edge bounding a rear opening;

iii. a constriction located forward of said rear opening that secures said ballast within said tubular body at the closed front end;

iv. a tail portion from said constriction to said rear edge; and b. a weapon shell for receiving said projectile.

16. The low lethality munition of claim 15 wherein:

a. said constriction is created by binding a portion of said tubular body forward of said rear edge.

17. The low lethality munition of claim 15 wherein:

a. said tubular body is sock-like in shape.

18. The low lethality munition of claim 15 wherein:

a. said ballast is lead shot.

19. The low lethality munition of claim 15 wherein:

a. said ballast is comprised of particulate matter.

20. The low lethality munition of claim 15 wherein:

a. said tubular body is comprised of fabric material.

21. The low lethality munition of claim 15 wherein:

a. said weapon shell is a 12 gauge shotgun shell.

22. The low lethality munition of claim 15 wherein:

a. said weapon shell is at least 37 mm in diameter.

23. The low lethality munition of claim 15 wherein:

a. said weapon shell is at least 40 mm in diameter.

* * * * *